US005654520A

United States Patent [19]

Boberg et al.

[11] Patent Number: 5,654,520

[45] Date of Patent: Aug. 5, 1997

[54] DELAY CHARGE AND ELEMENT, AND DETONATOR CONTAINING SUCH A CHARGE

[75] Inventors: Tore Boberg; Staffan Carlsson, both of Karlskoga; Britt-Marie Ekman, Nora; Bo Karlsson, Örebro, all of Sweden

[73] Assignee: Nitro Nobel AB, Nora, Sweden

[21] Appl. No.: 544,057

[22] Filed: Oct. 17, 1995

Related U.S. Application Data

[63] Continuation of Ser. No. 157,288, Nov. 26, 1993, abandoned.

[30] Foreign Application Priority Data

Nov. 27, 1992 [SE] Sweden ..... 9203571

[51] Int. Cl.[6] ..... F42C 19/08; C06B 33/00

[52] U.S. Cl. ..... 102/205; 149/37; 149/19.7

[58] Field of Search ..... 149/37, 19.7; 102/205

[56] References Cited

U.S. PATENT DOCUMENTS

| | | | |
|---|---|---|---|
| 2,716,599 | 8/1955 | Heiskell . | |
| 3,969,067 | 7/1976 | Schupp | 149/37 |
| 4,015,355 | 4/1977 | Schiessl et al. | 149/37 |
| 4,094,028 | 6/1978 | Fujiyama et al. | 149/35 |
| 4,184,901 | 1/1980 | Tanner et al. | 149/19.6 |
| 4,374,686 | 2/1983 | Davitt et al. | 149/37 |
| 4,419,153 | 12/1983 | Boberg . | |
| 4,455,178 | 6/1984 | Sédat | 149/37 |
| 5,147,476 | 9/1992 | Beck et al. | 149/37 |

FOREIGN PATENT DOCUMENTS

| | | |
|---|---|---|
| 2049890 | 12/1980 | United Kingdom . |
| 2098977 | 12/1982 | United Kingdom . |
| 2241946 | 9/1991 | United Kingdom . |

OTHER PUBLICATIONS

"Studies on Gasless Delay Compositions Containing Boron and Bismuth Trioxide", by N. Davies et al., from the *10th International Pyrotechnics Seminar* held in Germany during Jul., 1985.

*Chemical Abstracts*, vol. 103, No. 24, Abstract No. 198070j, "Studies on Gasless Delay Compositions Containing Boron and Bismuth Trioxide", N. Davies et al. (1985).

Hampel, *Rare Metals Handbook*, p. 65, Reinhold Publ. Corp. (1954) New York.

STN Search—$Bi_2O_3$, RN 1304–76–3.

De Yong et al., *Chem Abs.*, 105 abs. #193917, of (report) Mater. Res. Lab. (Anst.) (1986) MRL–R–998, 19 pp.

*Primary Examiner*—Edward A. Miller

*Attorney, Agent, or Firm*—Burns, Doane, Swecker & Mathis, L.L.P.

[57] ABSTRACT

A pyrotechnic delay charge for providing delays in the millisecond and second ranges, comprising the components bismuth oxide as an oxidation agent and silicon as a fuel. The invention also relates to a pyrotechnic delay element having an enclosure containing the pyrotechnical delay charge, and to a detonator having a housing, ignition means disposed at one end of the housing, a base charge of a secondary explosive disposed at the other end of the housing and the pyrotechnic delay charge disposed therebetween.

22 Claims, No Drawings

DELAY CHARGE AND ELEMENT, AND DETONATOR CONTAINING SUCH A CHARGE

This application is a continuation, of application Ser. No. 08/157,288, filed Nov. 26, 1993, now abandoned.

TECHNICAL FIELD

The present invention relates to a pyrotechnic delay charge for providing delays in the millisecond and second ranges.

BACKGROUND

Pyrotechnic delay charges are used in many fields, both military and civil, to provide a time delay between an inititating signal, for instance from an electrically activated fuse head or from a fuse, and triggering of a main reaction, such as ignition of a propulsive charge or triggering of a blasting charge. The charges will be described below in greater detail in relation to detonators for civil rock fragmentation.

A leading requirement for pyrotechnic delay charges is that they should burn with a well defined and stable burn rate having an insignificant time scatter. The burn rate should not be significantly influenced by the surrounding conditions or aging. Because of this, a burn having insignificant gas evolution and initial materials, intermediates and end-products with favourable and stable properties is required. The charges should be easily ignitable and provide good ignition transfer to other materials but without being excessively sensitive to jolts, vibration, friction or static electricity. The nominal rate should be adjustable with minor modifications of the charges. The charge compositions should be easy to prepare, dose and compress in safety. The charges should have a high energy content per unit weight and the incorporated components should not be too expensive.

Although conventional pyrotechnic elements can be said, in principle, to consist of a fuel and an oxidant, and therefore many substances should be usable, the above described requirements together significantly limit the choice of suitable initial materials. The component choice has come to be concentrated around a few established components within each field of application. For example, lead compounds are common ingredients in civil detonators.

Even though the amounts of pyrotechnic charge in the majority of initiator types are relatively small, there is a growing requirement that the charges should not contain toxic substances. This is in order to avoid problems during manufacture, to reduce emissions and also to lessen the problem of exposure at the point of end-use. It is also desirable that the preparation of the charges can be done without using solvents. Several components previously used in pyrotechnic elements are now no longer usable, for instance heavy metals.

A number of charges have been proposed with the goal of uniting good pyrotechnic properties with insignificant health consequences. For example, Swedish patent nos. 446 180 and 457 380 describe charges based on, inter alia, tin oxide as a principal non-toxic oxidant. However, these charges have less satisfactory properties as regards time adjustment and manufacture.

THE INVENTION IN GENERAL

A principal object of the present invention is to provide a delay charge which well fulfills the above general requirements for such charges. A particular object is to provide charges which have stable and reproducible burn times and suitable initial, intermediate and end-product properties. A further object is to provide a charge which does not contain toxic components. An additional object is to provide a charge which is water-insoluble, non-hygroscopic, which may be mixed or prepared in aqueous media, and which is also in other respects easy to handle and safe. Yet another object is to provide a charge which is energy dense and relatively cheap.

These objects are attained with the distinguishing features apparent in the patent claims.

In accordance with the invention, there is provided a delay charge comprising elemental silicon and bismuth oxide. These components are chemically stable, burn without substantial gas evolution and form stable residue products. The resulting delay periods are reproducible, linear and have insignificant scatter. The charges are easy to initiate, even without start charges. The components are entirely non-poisonous. The components are non water-soluble, non-hygroscopic and can be prepared in water. The components are easily handled and have a low price. Also, in other respects, the components exhibit suitable properties in the abovementioned considerations.

Additional objects of the invention and the benefits attained will be apparent from the detailed description below.

DETAILED DESCRIPTION

The charge of the invention can be used for various pyrotechnic objectives, for instance as a start charge, firing charge or transfer charge but the main use is as a delay charge. A suitable burn rate for the charge of the invention is in the range of 10 to 200 mm/s, preferably between 15 and 150 mm/s and especially between 20 and 120 mm/s. For civil detonator applications, the charge is convenient for providing delays of the order of 10 to 3000 ms and especially between 20 and 2000 ms. These charges are hereafter referred to as "fast charges". The invention, however, is also suited to slower charges having burn rates in the range of 1 to 20 mm/s, and especially between 3 and 15 mm/s which are convenient for delays in the range of 0.5 to 10 seconds, especially 1 to 8 seconds. These charges are hereafter referred to as "slow charges". Primers and ignition charges may have burn rates above 150, especially above 200 mm/s.

Without limiting the invention to any theory of function or reaction, and especially not when more than the obligatory components are incorporated, the silicon component will be described below as a fuel component and the bismuth oxide component as an oxidant.

The silicon may be in the amorphous or preferably the crystalline form of the usual grade in the pyrotechnics context. The bismuth oxide is preferably dibismuth trioxide.

The relative amounts of silicon and bismuth oxide can be varied within wide limits. Mixtures which are stoichiometrically deficient in fuel may be used, especially for slow charges. A surplus of the fuel component relative to the oxidant is usually preferred. Under the premise that the silicon reacts to form silicon dioxide and the dibismuth trioxide is reduced to elemental form, a surplus of the silicon in relation to the stoichiometrically necessary amount (3:2) is preferred, preferably a mole ratio in excess of 2:1 or more preferably 3:1. The mole ratio should not exceed 6:1 and it is best not to exceed 5:1.

In absolute terms, it is preferred that the charge contains at least 10 weight percent of silicon, preferably more than 15 weight percent and most preferably more than 20 weight percent. However, the content may be lower and may, for example, go down to around 1 weight percent but is preferably above 2 weight percent. These low amounts of silicon are preferably used for slow charges or in situations where other fuel is incorporated, such as zirconium. The amount of dibismuth trioxide should exceed 30 weight percent, preferably exceeding 40 weight percent and more preferably exceeding 50 weight percent.

Over and above these obligatory components, other reactive and/or inert pyrotechnic additives may be incorporated in order to modify the burn rate or otherwise influence the reaction properties. Similarly, these additives should not give rise to gas releases. Examples of additives include fuels such as zirconium and boron or alternative oxidants such as iron oxide and manganese oxide or more inert components such as silicon oxide and titanium oxide.

The amount of such reactive additives is normally selected so that the total fuel/oxidant relationship falls within the above indicated range. The total amount of additives should not exceed 55 weight percent, preferably not exceeding 45 weight percent and more preferably under 30 weight percent.

Zirconium is a preferred alternative fuel, Which provides, inter alia, enhanced ignitability and increased reaction rate. The amount may vary within wide limits, principally depending on the desired speed of the charge and may, for example, be between 1 and 50 weight percent, especially between 3 and 25 weight percent. Slow charges may have a content of between 1 and 20 weight percent, especially between 3 and 15 weight percent. Fast charges may, for example, have a content between 3 and 50 weight percent, especially between 5 and 25 weight percent. Primers and ignition charges may have a high content, for example exceeding 25 weight percent.

Additives other than pyrotechnic additives may also be incorporated in the charge, for example to improve the properties of the powder in relation to free flow and compactability, or binder additives to improve coherency or to allow granulation, for example clay minerals such as bentonite or carboxymethyl cellulose. The amounts of these sorts of additive are generally kept minor, for example below 4 weight percent, preferably below 2 weight percent and even more preferably under 1 weight percent. The lower of these limits appropriately apply to gas-releasing additives of this type, or are appropriate to gas-releasing additives in general, such as organic additives but also to inorganic additives such as chlorates.

The charges, in the usual manner, are preferably in the form of powder mixtures. The particle size may be used to influence the burn rate. The particle size of the incorporated main components, expressed as a weight average, may be between 0.1 and 100 microns, preferably between 1 and 50 microns. These values may also be appropriate for other optional pyrotechnic powder additives. The powder components or preferably the powder mixture may be granulated in order, for example, to facilitate dosing and compression.

The charges are relatively insensitive to unintended initiation and may be mixed and prepared in the dry state. It is preferred, however, that this is effected in the liquid state. The liquid may be an organic solvent but aqueous media and especially pure water are preferred because the components are water-insensitive. The mixture may be granulated from the liquid phase.

The charges may, as has been indicated, be used for all sorts of pyrotechnic applications, such as ignition charges, start charges etc, but preferably as delay charges, especially in civil detonators. In this connection, the charges are placed in the form of a layer directly in a detonator housing or are accommodated as a column in a surrounding housing element which is inserted into the detonator housing. The charge is placed between a component ignition device, for example a detonating cord, a low energy fuse (for instance Nonel, registered trade mark) or an electrically activated fuse head, and a functional main charge, usually a base charge of secondary explosive. The charge has sufficient initiation ability to be ignited by conventional ignition devices even without a special preceding primer, although these may be used if so desired. In the outward end, the charge may be allowed to act on a primary explosive, optionally via a transfer charge, or to directly ignite a secondary explosive, for example in the primary explosive-free detonator of the type apparent in Swedish patent application nos. 8404208-4 or 8803683-5, which are specifically incorporated herein by reference.

The above charges are generally press compacted. The exact pressure of the press varies with the length of the charge, the form of the element etc. Appropriate end-densities may be within 10 and 80 percent of the crystal density of the mixture, especially between 20 and 60 percent of the crystal density.

The invention will be further exemplified with the following preferred but non-limiting embodiments.

EXAMPLES

A series of test charges was manufactured in accordance with the Examples below. The grain sizes of the incorporated components were determined prior to admixture with the "Fisher Sub Seive Sizer" method. Admixing of the charges was effected in aqueous phase (c. 40–50 weight percent water) with minor amounts of CMC as binder. The order of admixture was: dispersal of the bismuth oxide, addition of the binder in solution form, successive additions of the silicon powder and lastly addition of other, optional components to the mixture. Admixture was effected with the intensive mixer method. After admixture, the charges were oven-dried on trays to a moisture content of around 7 to 10 weight percent, after which granulation was effected on a seive cloth having a 0.8 mm mesh size, following which the granules were dried to a moisture content below 0.1 weight percent.

The charges were compressed with a pressure of about 1000 kp/cm$^2$ in delay elements of aluminium with an inner diameter of 3 mm and a length of 20 mm. The elements were inserted into detonators of the primary explosive containing type as well as the primary explosive-free type and were initiated with a low energy fuse of the Nonel (registered trade mark) type.

The figures indicated below for burn rates are based upon delay periods measured for at least 10 of such detonators for each charge. Elements have also been subjected to storage in humid and warm environments (+40° C. and 75% relative humidity). These elements were then inserted into detonators and test-fired as above and showed to have maintained completely satisfactory functions and only insignificantly altered burn rates.

Example 1

A test charge was prepared in accordance with the following specification in which the percentages relate to weight percent and the particle sizes relate to average particle diameter:

28% Si (silicon), particle size 3 μm

5% Zr (zirconium), particle size 2 μm

67% $Bi_2O_3$ (dibismuth trioxide), particle size 5 μm

The burn rate was measured as 76 mm/second.

Example 2

A test charge was prepared in accordance with the following specification in which the percentages relate to weight percent and the particle sizes relate to average particle diameter:

30% Si (silicon), particle size 3 μm

20% Zr (zirconium), particle size 2 μm

50% $Bi_2O_3$ (dibismuth trioxide), particle size 5 μm

The burn rate was measured as 100 m/second.

Example 3

A test charge was prepared in accordance with the following specification in which the percentages relate to weight percent and the particle sizes relate to average particle diameter:

40% Si (silicon), particle size 3 μm

60% $Bi_2O_3$ (bismuth trioxide), particle size 5 μm

The burn rate was measured as 35 mm/second.

Example 4

A test charge was prepared in accordance with the following specification in which the percentages relate to weight percent and the particle sizes relate to average particle diameter:

30% Si (silicon), particle size 5 μm

20% MnO (manganese oxide) particle size 4 μm

50% $Bi_2O_3$ (dibismuth trioxide), particle size 5 μm

The burn rate was measured as 20 m/second.

Example 5

A test charge was prepared in accordance with the following specification in which the percentages relate to weight percent and the particle sizes relate to average particle diameter:

32% Si (silicon), particle size 3 μm

60% $Bt_2O_3$ (dibismuth trioxide), particle size 5 μm

8% $SiO_2$ (silicon dioxide), particle size <1 μm

The burn rate was measured as 11 m/second.

Example 6

A test charge was prepared in accordance with the following specification in which the percentages relate to weight percent and the particle sizes relate to average particle diameter:

3% Si (silicon), particle size 3 μm

10% Zr (zirconium) particle size 2 μm

60% $Bi_2O_3$ (dibismuth trioxide), particle size 5 μm

27% $TiO_2$ (titanium dioxide), particle size <1 μm

The burn rate was measured as 9 mm/second.

Example 7

A test charge was prepared in accordance with the following specification in which the percentages relate to weight percent and the particle sizes relate to average particle diameter:

5% Si (silicon), particle size 3 μm

8% Zr (zirconium) particle size 2 μm

62% $Bi_2O_3$ (dibismuth trioxide), particle size 5 μm

25% $TiO_2$ (titanium dioxide), particle size <1 μm

The burn rate was measured as 7 mm/second.

Example 8

A test charge was prepared in accordance with the following specification in which the percentages relate to weight percent and the particle sizes relate to average particle diameter:

3% Si (silicon), particle size3 μm

97% $Bi_2O_3$ (dibismuth trioxide), particle size 5 μm

The burn rate was measured as 5 mm/seconds.

We claim:

1. A pyrotechnic delay charge composition, comprising dibismuth trioxide oxidation agent in an mount exceeding 30% by weight and silicon as a fuel, wherein the delay charge composition is nontoxic and water-insoluble and provides stable and reproducible delays.

2. A charge according to claim 1, comprising more than 2% by weight silicon.

3. A charge according to claim 1, comprising more than 15% by weight silicon.

4. A charge according to claim 1, including an additive as an additional component comprising a reactive or inert pyrotechnic component in an amount up to 55% by weight of the charge composition.

5. A charge according to claim 4, wherein the additive comprises zirconium.

6. A charge according to claim 5, wherein the amount of zirconium is between 1 and 47% by weight of the charge.

7. A charge according to claim 6, wherein the amount of zirconium is between 3 and 25% by weight of the charge.

8. A charge according to claim 1, wherein the charge has a stoichiometric excess of fuel.

9. A charge according to claim 1, wherein the charge includes as an additional component a binder in an amount of up to 4% by weight of the charge.

10. A charge according to claim 9, wherein the binder is carboxymethyl cellulose.

11. A charge according to claim 1, wherein the components are in the form of a powder having particle sizes between 0.1 and 100 microns, expressed as a weight average.

12. A charge according to claim 11, wherein the components or the charge itself is in the form of granules.

13. A charge according to claim 1, having a burn rate between 1 and 20 mm/s.

14. A charge according to claim 1, having a burn rate between 10 and 200 mm/s.

15. A charge according to claim 1, having a density between 20 and 60% of the density obtained if the charge were in a crystallized form.

16. A pyrotechnic delay element, comprising an enclosure and in the enclosure a pyrotechnic delay charge composition comprising silicon as a fuel and dibismuth trioxide oxidation agent in an mount exceeding 30% by weight, wherein the delay charge composition is nontoxic, water-insoluble and provides a stable and reproducible delay between an initiating signal and a main reaction.

17. An element according to claim 16, wherein the enclosure comprises a detonator housing.

18. An element according to claim 16, wherein the enclosure comprises a substantially cylindrical metal casing.

19. An element according to claim 16, wherein the charge composition has a substantially cylindrical shape.

20. An element according to claim 19, wherein the diameter of the substantially cylindrical shape is between 1 and 10 mm.

21. An element according to claim 19, wherein the length of the substantially cylindrical shape is between 1 and 100 mm.

22. An element according to claim 19, wherein the length of the substantially cylindrical shape is between 2 and 50 mm.

* * * * *